US009464426B1

(12) United States Patent
Schaetzke et al.

(10) Patent No.: US 9,464,426 B1
(45) Date of Patent: Oct. 11, 2016

(54) CARRIER FACEPLATE

(75) Inventors: Frank Schaetzke, Pipersville, PA (US); Douglas R. Wroblewski, Erie, PA (US); David Gomo, Waterford, PA (US); Ben Eichler, Erie, PA (US)

(73) Assignee: Zurn Industries, LLC, Milwaukee, WI (US)

( * ) Notice: Subject to any disclaimer, the term of this patent is extended or adjusted under 35 U.S.C. 154(b) by 1331 days.

(21) Appl. No.: 11/949,246

(22) Filed: Dec. 3, 2007

Related U.S. Application Data

(60) Provisional application No. 60/874,936, filed on Dec. 14, 2006.

(51) Int. Cl.

| | |
|---|---|
| ***E03D 11/00*** | (2006.01) |
| ***E03D 11/16*** | (2006.01) |
| ***E03D 11/17*** | (2006.01) |
| ***A47K 17/00*** | (2006.01) |
| ***E03D 11/14*** | (2006.01) |
| ***E03C 1/01*** | (2006.01) |

(52) U.S. Cl.
CPC *E03D 11/14* (2013.01); *E03C 1/01* (2013.01)

(58) Field of Classification Search
CPC ... E03D 11/14; E03D 11/143; E03D 11/135; E03D 1/01; Y10S 4/15
USPC ..... 4/252.1–252.6, 661
See application file for complete search history.

(56) References Cited

U.S. PATENT DOCUMENTS

| | | | | |
|---|---|---|---|---|
| 1,471,154 | A * | 10/1923 | Graham | 4/252.2 |
| 3,271,054 | A * | 9/1966 | Schmid | 285/93 |
| 3,271,794 | A * | 9/1966 | Flegel et al. | 4/252.2 |
| 3,278,950 | A * | 10/1966 | Hutchins | 4/252.2 |
| 3,286,280 | A * | 11/1966 | Duggan | 4/252.2 |
| 3,323,143 | A * | 6/1967 | Pope | 4/252.3 |
| 3,435,467 | A * | 4/1969 | Flegel et al. | 4/252.2 |
| 3,540,065 | A * | 11/1970 | Schmid et al. | 4/420 |
| 3,686,695 | A * | 8/1972 | Mielback et al. | 4/252.3 |
| 4,108,477 | A * | 8/1978 | Morris | 285/58 |
| 4,979,239 | A * | 12/1990 | Klein et al. | 4/645 |
| 6,979,027 | B2 * | 12/2005 | Hetzler et al. | 285/337 |
| 2009/0249535 | A1 * | 10/2009 | Eichler et al. | 4/252.2 |

FOREIGN PATENT DOCUMENTS

| | | | | |
|---|---|---|---|---|
| GB | 2223042 | A * | 3/1990 | E03D 11/14 |

OTHER PUBLICATIONS

Zurn Z-1203-H specification sheet dated Aug. 9, 1994 (1 page).

* cited by examiner

*Primary Examiner* — Len Tran
*Assistant Examiner* — Steven M Cernoch
(74) *Attorney, Agent, or Firm* — Quarles & Brady LLP

(57) ABSTRACT

A one-piece faceplate for supporting a wall mounted toilet above a floor surface having a faceplate body that defines a receiving hole extending therethrough configured to receive a waste discharge conduit is provided. Further, a support member extends from at least one surface of the faceplate body that is configured to contact the floor surface, thereby providing support to a wall mounted toilet. The support member is non-adjustable relative to the faceplate body. The faceplate body has a collar extending outwardly therefrom around the periphery of the receiving hole. The receiving hole is adapted to receive contents from the waste discharge conduit upon threadable engagement with the collar. Additionally, a method for providing a faceplate for supporting a wall mounted toilet is also provided.

18 Claims, 4 Drawing Sheets

CARRIER FACEPLATE

CROSS REFERENCE TO RELATED APPLICATION

This application is based on Provisional Patent Application No. 60/874,936 filed Dec. 14, 2006, on which priority of this patent application is based, and which is hereby incorporated by reference in its entirety.

BACKGROUND OF THE INVENTION

1. Field of the Invention

The present invention relates generally to carrier faceplates for supporting wall mounted toilets or water closets, and a method for providing and using the same.

2. Description of Related Art

Wall mounted toilets or water closets are known in the art. In order to mount a toilet to the wall, and in order to support the weight of a user on said toilet, it is common to provide a suitable support system, that includes a carrier faceplate, disposed behind the wall for supporting both the toilet and related plumbing. One example of such a carrier is a Zurn® Z-1203-H carrier.

Heretofore, carrier faceplates have been multiple-piece systems that incorporate adjustable feet. Installers of these faceplates must adjust the feet (or bottom piece) of the carrier faceplate to properly size the carrier as needed for each job. This is not only time consuming, but also costly.

Thus, it is an object of the present invention to provide a non-adjustable, one-piece carrier faceplate, and method for using the same, that allows installation of the carrier faceplate in an expedient and cost-efficient manner.

SUMMARY OF THE INVENTION

Generally, the present invention is directed to a one piece carrier faceplate for supporting wall mounted toilets or water closets. More particularly, the present invention is directed to a one-piece carrier faceplate and a method for providing and using the same.

The present invention provides a one-piece faceplate for supporting a wall mounted toilet above a floor surface having a faceplate body that defines a receiving hole extending therethrough configured to receive a waste discharge conduit. Further, a support member extends from at least one surface of the faceplate body that is configured to contact the floor surface, thereby adapted to provide support to a wall mounted toilet. The support member is non-adjustable relative to the faceplate body. The faceplate body has a collar extending outwardly therefrom around the periphery of the receiving hole. The receiving hole is adapted to receive contents from the waste discharge conduit upon threadable engagement with the collar.

The faceplate body further defines a plurality of elongated through slots adapted to receive screws or other fastening means to fixably connect the faceplate body to a plumbing system. Additionally, the faceplate body defines a plurality of mounting holes adapted to receive screws or other fastening means that extend through a portion of a wall to fixably connect the faceplate body to a wall mounted toilet.

The carrier faceplate of the present invention may also have a plurality of support members, each extending from at least one surface of the faceplate body. Each support member is configured to contact a floor surface to support a wall mounted toilet and is non-adjustable relative to the body of the carrier faceplate.

The present invention also provides a method of providing a faceplate for supporting a wall mounted toilet above a floor surface. The method includes the steps of: 1) determining the desired placement height of the receiving hole on the faceplate; 2) ordering the faceplate according to the determined placement height obtained in step 1); 3) manufacturing the faceplate according to the order received in step 2), wherein the faceplate has a faceplate body defining a receiving hole extending therethrough configured to receive a waste discharge outlet conduit and a support member extends from at least one surface of the faceplate body configured to contact the floor surface, thereby adapted to support the wall mounted toilet, and wherein the support member is non-adjustable relative to the faceplate body; and 4) delivering the faceplate provided from step 3) to its needed location. Once at its needed location, the method further includes the step of installing the faceplate delivered from step 4).

With the aforementioned method, the faceplate body has a collar extending outwardly therefrom around the periphery of the receiving hole. The receiving hole is adapted to receive contents from the waste discharge conduit upon threadable engagement with the collar. Further, as described above, the faceplate body defines a plurality of elongated through slots adapted to receive screws or other fastening means to fixably connect the faceplate body to a plumbing system. Additionally, the faceplate body defines a plurality of mounting holes adapted to receive screws or other fastening means that extend through a portion of a wall to fixably connect the faceplate body to a wall mounted toilet. The faceplate body may be made of cast metal, such as brass, bronze or iron from sand castings. Further, the faceplate body and the support member are a unitary piece. Additionally, the centerline of the receiving hole may be 5¼", 7¼" or 8¼" from the bottom surface of the support member.

Further, the present invention provides a method of providing a faceplate for supporting a wall mounted toilet above a floor surface. The method includes the steps of: 1) determining a desired placement height of a receiving hole on the faceplate; 2) ordering the faceplate according to the determined placement height obtained in step 1); 3) manufacturing the faceplate via casting metal according to the order received in step 2), wherein the faceplate has a faceplate body defining a receiving hole extending therethrough configured to receive a waste discharge outlet conduit and a support member extends from at least one surface of the faceplate body configured to contact the floor surface, thereby adapted to support the wall mounted toilet, wherein the support member is non-adjustable relative to the faceplate body, and, wherein the faceplate body has a collar extending outwardly therefrom around the periphery of the receiving hole; and 4) delivering the faceplate provided from step 3) to its needed location. Once at its needed location, the method further includes the step of installing the faceplate delivered from step 4). The installation step includes attaching a toilet to the faceplate body. Further, the installation step included attaching flow members to the faceplate body without adjusting the support member with respect to the faceplate body.

These and other advantages of the present invention will be understood from the detailed description of the invention, taken with the accompanying drawings, wherein like reference numerals represent like elements throughout.

DETAILED DESCRIPTION OF THE INVENTION

Figure 1:
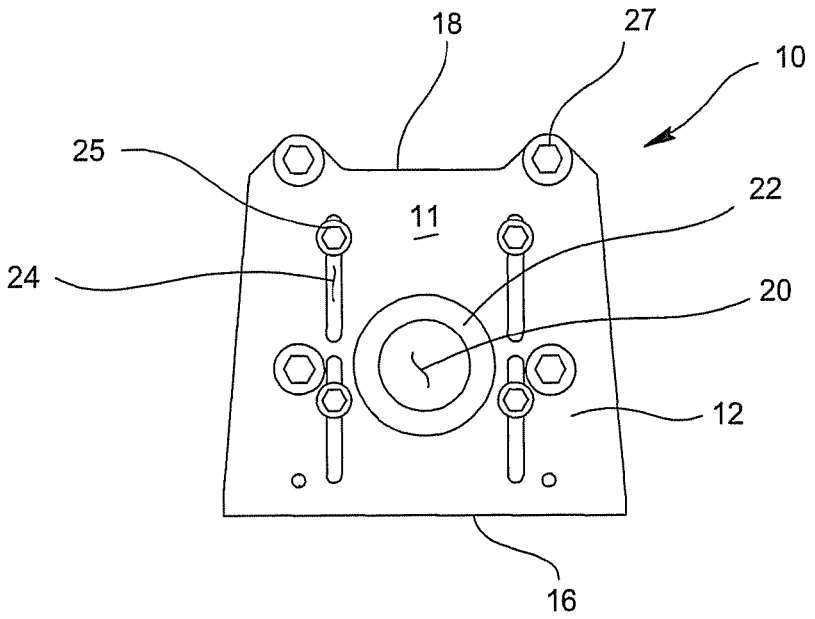
FIG. 1 is a front plan view of a one-piece carrier faceplate and associated hardware in accordance with the present invention.
Figure 2:
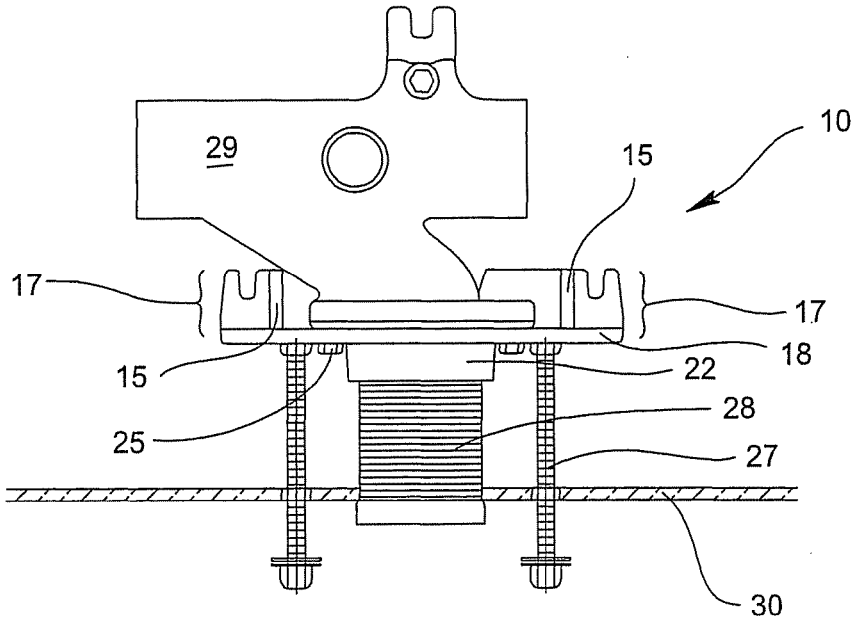
FIG. 2 is a top plan view of the carrier faceplate and associated hardware of FIG. 1 shown mounted to a wall and coupled to a waste discharge conduit.
Figure 3:
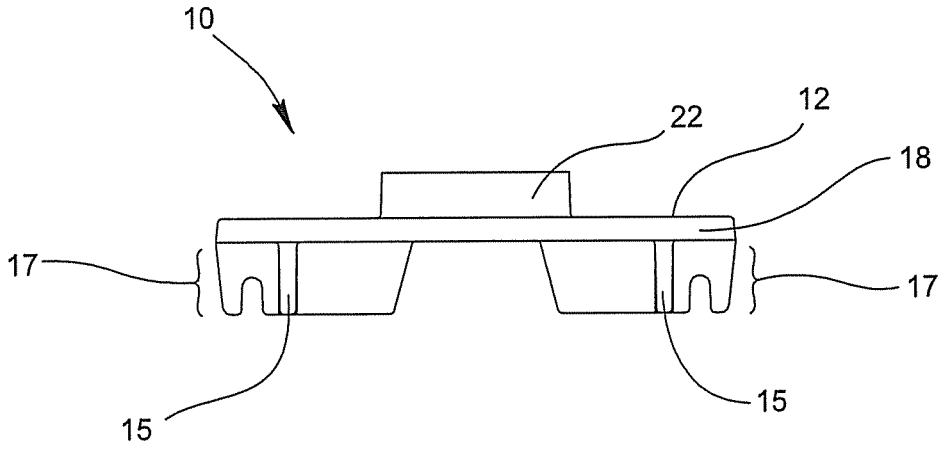
FIG. 3 is a top plan view of the carrier faceplate of FIG. 1.
Figure 4:
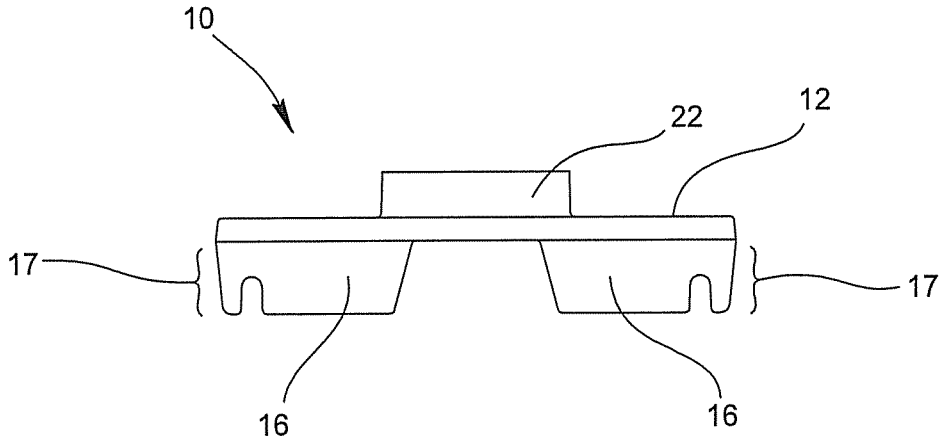
FIG. 4 is a bottom plan view of the carrier faceplate of FIG. 1.
Figure 6:
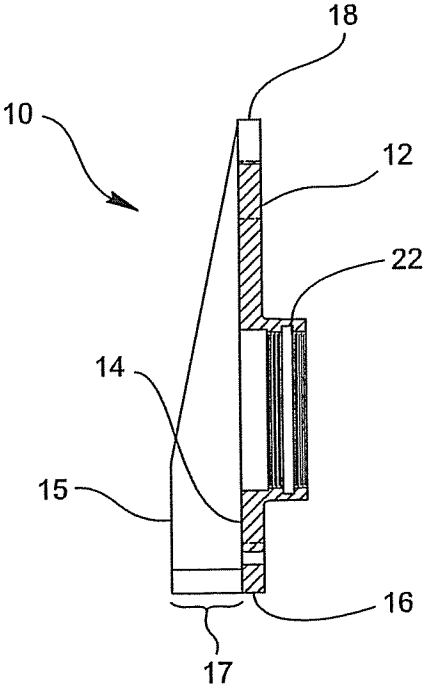
FIG. 6 is a cross-sectional view of the carrier faceplate of FIG. 1 taken along lines 6-6 of FIG. 5.

For purposes of the description hereinafter, spatial or directional terms shall relate to the invention as it is oriented in the drawing figures. However, it is to be understood that the invention may assume various alternative variations, except where expressly specified to the contrary. It is also to be understood that the specific components illustrated in the attached drawings, and described in the following specification, are simply exemplary embodiments of the invention. Hence, specific dimensions and other physical characteristics related to the embodiments disclosed herein are not to be considered as limiting.

FIGS. 1-8 show a one piece, unitary carrier faceplate 10 according to the present invention. Referring to FIGS. 1-6, the body 11 of the carrier faceplate 10 has a first, front surface 12 and a second, rear surface 14 on the back side thereof. The body 11 of the carrier faceplate 10 also has a third, bottom supporting surface 16 and a fourth, top surface 18. The third, bottom supporting surface 16 of the carrier faceplate 10 extends outwardly past the second, rear surface 14 forming at least one ledge-like support member 17 having a top surface extending outwardly from the second, rear surface 14. Each support member 17 is given structural support via at least one flange 15 that extends outwardly from, and vertically along the length of, the second, rear surface 14 meeting and engaging the support member 17 at the top surface of the support member 17. Further, the body 11 of the carrier faceplate 10 defines a receiving hole 20 that is centrally located or substantially centrally located about the carrier faceplate 10 that extends through the first, front surface 12 and the second, rear surface 14. A collar 22 surrounds the periphery of the receiving hole 20 and the collar 22 extends outwardly from the first, front surface 12. The receiving hole 20 is adapted to receive a waste discharge conduit 28 that is in fluid communication with a plumbing system 29 (shown in FIGS. 2, 7 and 8) upon threadable engagement with the collar 22. The plumbing system 29 and discharge conduit 28 define flow members. Discharge conduit 28 and plumbing system 29 are utilized in the prior art systems, such as the previous discussed Zurn® Z-1203-H carrier.

Figures 7, 8:
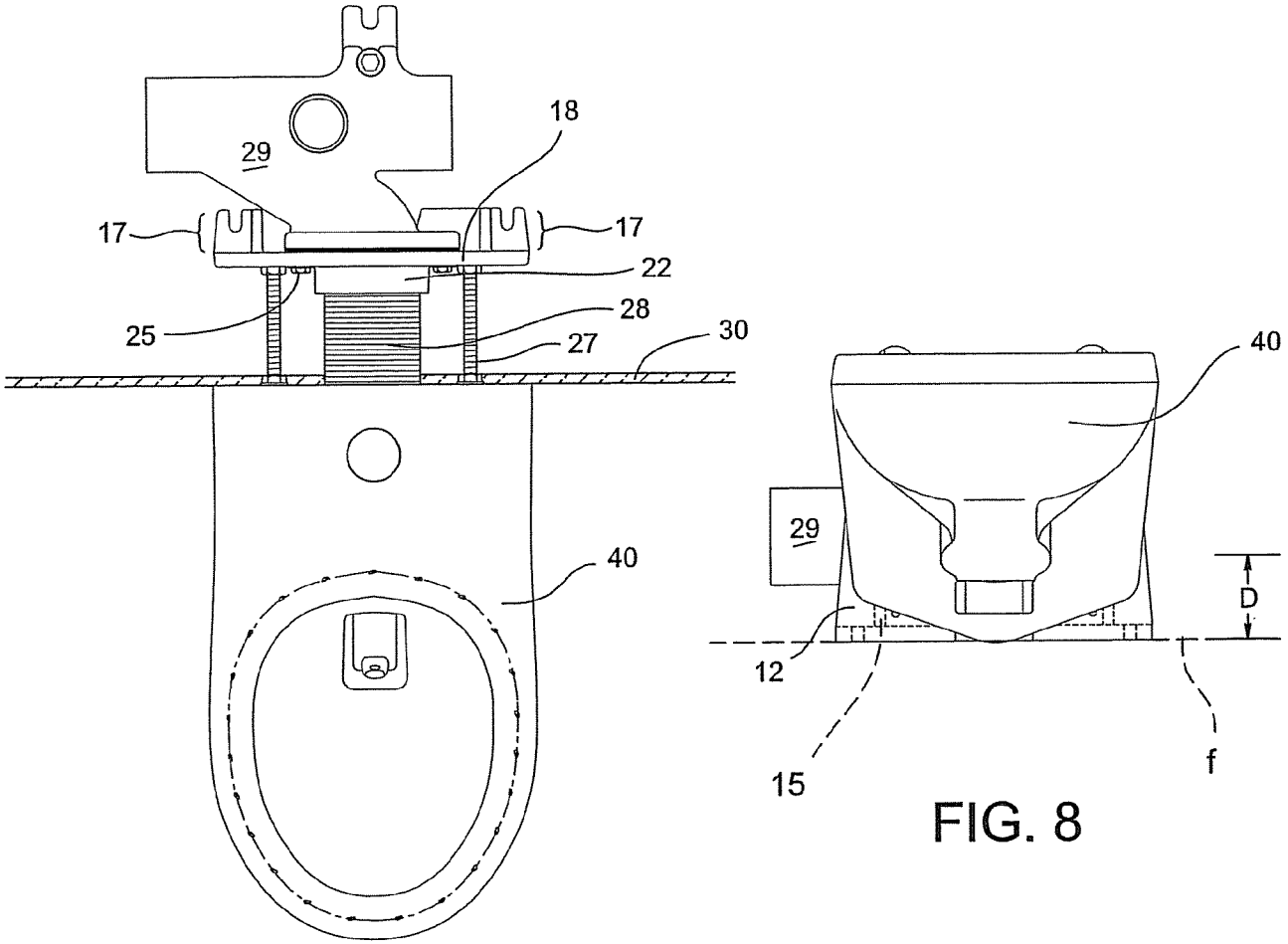
FIG. 7 is top plan view of the carrier faceplate and associated hardware of FIG. 1 shown supporting a wall mounted toilet and coupled to a waste discharge conduit.
FIG. 8 is a front plan view of the wall mounted toilet of FIG. 7 being supported by the carrier faceplate of FIG. 1 shown upon a floor (the wall is not shown).

The body 11 of the carrier faceplate 10 also defines a plurality of elongated through slots 24 (shown in FIGS. 1 and 5) that receive screws 25 (shown in FIGS. 1, 2 and 7) or other fastening means to fixably connect the carrier faceplate 10 to the plumbing system 29. Additionally, the body 11 of the carrier faceplate 10 also has a plurality of mounting holes 26 (shown in FIGS. 1 and 5) that receive screws 27 or other fastening means passing through a wall 30 to fixably connect the carrier faceplate 10 to a toilet 40 (shown in FIGS. 1, 2 and 7). As shown in FIGS. 7 and 8, once assembled, the carrier faceplate 10 is able to support the weight of a wall mounted toilet 40 or water closet located on the opposite side of the wall 30 or other support structure. Further, a waste discharge conduit 28 is received by the receiving hole 20 of the collar 22 and is coupled to the plumbing system 29 (shown in FIGS. 2, 7 and 8).

Figure 5:
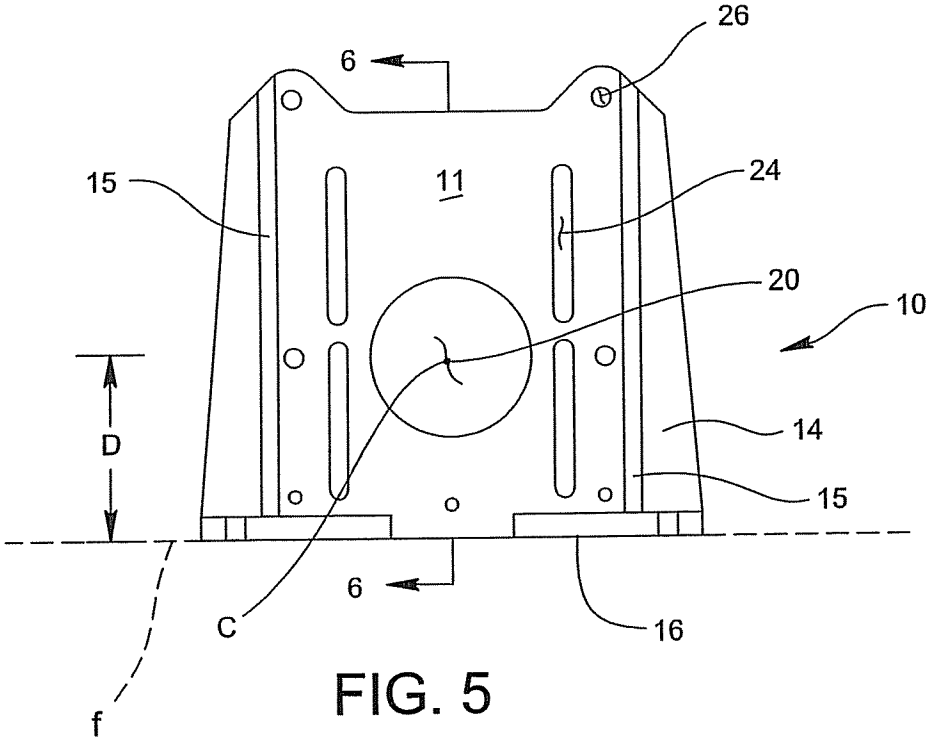
FIG. 5 is a rear plan view of the carrier faceplate of FIG. 1 shown upon a floor.

In order to install the carrier faceplate 10 of the present invention, the receiving hole 20 of the carrier faceplate 10 must be in proper alignment with the waste discharge conduit 28 so that the wall mounted toilet 40 is at the proper orientation. The carrier faceplate 10 can be manufactured in an infinite number of varying shapes and dimensions, depending on the needs of an end-user. Alternatively, a plurality of different sized carrier faceplates 10 can be provided. Further, the receiving hole 20 of the carrier faceplate 10 can also be manufactured in an infinite number of varying dimensions and shapes, depending on the needs of the end-user. This allows for installation of the carrier faceplate 10 without the need for adjustments by the installer as is the case with the prior art carriers. For example, the receiving hole 20 can vary in location within the carrier faceplate 10 on a horizontal plane. Preferably, the receiving hole 20 should have the same threaded diameter, although the centerline (C) of the receiving hole 20 can be moved vertically. Further allowing for easy installation on the site, the receiving hole 20 can be customized in its placement in height on the carrier faceplate 10 as measured from the third, bottom surface 16. For instance, examples of height dimensions measured from the bottom surface 16 of the body 11 of the carrier faceplate 10 to the centerline (C) of the receiving hole 20 can include, but are not limited to, 5¼", 7¼" and 8¼", represented as (D) and shown in FIGS. 5 and 8. As shown in FIGS. 5 and 8, these height dimensions correspond to rough-in heights measured from a floor (f) on which the third, bottom surface 16 and the extending support member 17 of the carrier faceplate 10 rest to the centerline (C) of the receiving hole 20.

The present invention also includes a method for providing a one-piece carrier faceplate 10 to an end-user. Essentially, the carrier faceplate 10 of the present invention can be custom-ordered and manufactured, reducing the need for excess inventory. The method includes the steps of: 1) taking measurements to determine the desired placement of the receiving hole 20 defined by the body 11 of the carrier faceplate 10; 2) ordering a carrier faceplate 10 according to the measurements obtained in step 1) (upon receipt of the pertinent dimension or dimensions, the body 11 of the carrier faceplate 10 can be molded or cast); typically, the body 11 of the carrier faceplate 10 is made of metal and is cast (although it is conceivable that the body 11 of the carrier faceplate 10 can be molded from a polymeric material); 3) manufacturing the body 11 of the carrier faceplate 10 according to the order received in step 2); and 4) installing the carrier faceplate 10 manufactured in step 3).

In one non-limiting embodiment, the method of providing a one-piece carrier faceplate 10 according to the present invention occurs as follows: 1) an installer and/or end-user of a carrier faceplate 10 takes measurements from the floor (f) behind a wall 30 that is to support a wall mounted toilet 40 to the centerline (C) of the location of a waste discharge conduit 28 (or the centerline of the receiving hole 20 that corresponds to the centerline of the waste discharge conduit 28) for a wall mounted toilet 40, or the like (see FIGS. 5 and 8 as this distance is designated as D); 2) an order is placed for a carrier faceplate 10 that matches the dimensions measured, such as, but not limited to, 5¼", 7¼", or 8¼" from the third, bottom surface 16 of the body 11 of the carrier faceplate 10 to the centerline (C) of the receiving hole 20; 3) a customized carrier faceplate 10 is manufactured or provided according to the dimensions received; 4) the carrier faceplate 10 is delivered to an installer; and 5) the manufactured carrier faceplate 10 is time-efficiently and cost-effectively installed by the installer. The present invention overcomes the deficiencies of prior art carrier faceplates that include several parts and require time to adequately adjust the faceplate dimensions. Because the carrier faceplate 10 has been made according to pre-determined dimensions and the support member 17 is non-adjustable relative to the body 11 of the carrier faceplate 10, installation of a wall mounted toilet 40 using the carrier faceplate 10 as support, is simplified and does not need to be performed by a registered plumber. The body 11 of the carrier faceplate 10 of the present invention is preferably one piece or unitary (for example, the carrier faceplate 10 is cast as one piece) and is made of brass, bronze or iron from sand castings. The different sizes and shapes available for the carrier faceplate 10 are created from a plurality of molds corresponding to the appropriate carrier faceplate 10 dimensions.

The present invention has been described with reference to the preferred embodiments. Modifications, combinations and alterations will occur to others upon reading the preceding detailed description. It is intended that the invention be construed as including all such modifications, combinations and alterations.

The invention claimed is:

1. A method of providing a faceplate for supporting a wall mounted toilet above a floor surface, comprising the steps of:

1) receiving an order for the faceplate having a receiving hole located therein at a desired placement height;

2) manufacturing a plurality of faceplates with receiving holes located therein at varying placement heights, wherein at least one of the plurality of faceplates is manufactured with the receiving hole located therein at the desired placement height according to the order received in step 1), wherein each one of the plurality of faceplates has a faceplate body defining the receiving hole extending therethrough, the receiving hole being configured to receive a waste discharge conduit, and a support member extending from the faceplate body configured to contact and rest on the floor surface, thereby supporting the wall mounted toilet, wherein the support member is a ledge formed by a bottom supporting surface of the faceplate body extending outwardly past the faceplate body to define a top surface of the ledge extending outwardly, and the faceplate body includes a flange extending outwardly therefrom, the flange extending vertically along a length of the faceplate body to meet and engage the top surface of the ledge of the support member providing structural support to the support member, wherein the support member and the faceplate body are non-adjustable relative to each other, and wherein the faceplate is separate and distinct from the floor surface; and 3) delivering the faceplate according to the order received in step 1), wherein the faceplate is one of the plurality of faceplates manufactured according to step 2) with the receiving hole located therein at the desired placement height.

2. The method of providing a faceplate of claim 1, wherein said faceplate body has a collar extending outwardly therefrom around the periphery of said receiving hole, and wherein said receiving hole is adapted to receive contents from said waste discharge conduit upon threadable engagement with said collar.

3. The method of providing a faceplate of claim 2, wherein said faceplate body further defines a plurality of elongated through slots adapted to receive screws or other fastening means to fixably connect said faceplate body to a plumbing system.

4. The method of providing a faceplate of claim 2, wherein said faceplate body further defines a plurality of mounting holes adapted to receive screws or other fastening means that extend through a portion of a wall to fixably connect said faceplate body to said wall mounted toilet.

5. The method of providing a faceplate of claim 1, wherein said faceplate body is composed of cast metal.

6. The method of providing a faceplate of claim 1, wherein a centerline of said receiving hole is 5¼", 7¼" or 8¼" from a bottom surface of said support member.

7. The method of providing a faceplate of claim 1, wherein said support member includes a structural support portion.

8. The method of providing a faceplate of claim 7, wherein said structural support portion comprises at least one flange.

9. The method of providing a faceplate of claim 1, wherein the at least one of the plurality of faceplates manufactured in step 2) with the receiving hole located therein at the desired placement height according to the order received in step 1) is a customized faceplate manufactured after receiving the order.

10. A faceplate for supporting a wall mounted toilet above a floor surface provided according to the method of claim 1.

11. The faceplate of claim 10, wherein said faceplate body has a collar extending outwardly therefrom around the periphery of said receiving hole, and wherein said receiving hole is adapted to receive contents from said waste discharge conduit upon engagement with said collar.

12. The faceplate of claim 11, wherein said faceplate body further defines a plurality of elongated through slots adapted to receive screws or other fastening means to fixably connect said faceplate body to a plumbing system.

13. The faceplate of claim 11, wherein said faceplate body further defines a plurality of mounting holes adapted to receive screws or other fastening means that extend through a portion of a wall to fixably connect said faceplate body to said wall mounted toilet.

14. The faceplate of claim 10, wherein said faceplate body is composed of cast metal.

15. The face plate of claim 10, wherein said faceplate body and the support member are a unitary piece.

16. The face plate of claim 10, wherein said faceplate comprises a plurality of support members, each of said support members extending from at least one surface of said faceplate body configured to contact said floor surface, thereby adapted to support a wall mounted toilet, wherein said support members are non-adjustable relative to said faceplate body.

17. A method of providing a faceplate for supporting a wall mounted toilet above a floor surface, comprising the steps of:

1) receiving an order for the faceplate having a receiving hole located therein at a desired placement height;

2) manufacturing via casting metal a plurality of faceplates with receiving holes located therein at varying placement heights, wherein at least one of the plurality of faceplates is manufactured with the receiving hole located therein at the desired placement height according to the order received in step 1), wherein each one of the plurality of faceplates has a faceplate body defining the receiving hole extending therethrough, the receiving hole being configured to receive a waste discharge conduit, and a support member extending from the faceplate body configured to contact and rest on the floor surface, thereby supporting the wall mounted toilet, wherein the support member is a ledge formed by a bottom supporting surface of the faceplate body extending outwardly past the faceplate body to define a top surface of the ledge extending outwardly, and the faceplate body includes a flange extending outwardly therefrom, the flange extending vertically along a length of the faceplate body to meet and engage the top surface of the ledge of the support member providing structural support to the support member, wherein the support member and the faceplate body are non-adjustable relative to each other, wherein the faceplate is separate and distinct from the floor surface, and wherein the faceplate body has a collar extending outwardly therefrom around the periphery of the receiving hole; and 3) delivering the faceplate according to the order received in step 1), wherein the faceplate is one of the plurality of faceplates manufactured according to step 2) with the receiving hole located therein at the desired placement height.

18. The method of providing a faceplate according to claim 17, wherein the at least one of the plurality of faceplates manufactured in step 2) with the receiving hole located therein at the desired placement height according to the order received in step 1) is a customized faceplate manufactured after receiving the order.

* * * * *